US005456351A

United States Patent [19]

Johnson

[11] Patent Number: 5,456,351

[45] **Date of Patent: * Oct. 10, 1995**

[54] METHOD AND APPARATUS FOR SUPPLYING TWO-PART SYSTEMS

[76] Inventor: Jimmie L. Johnson, 6267 Belmont Way, West Linn, Oreg. 97068

[ * ] Notice: The portion of the term of this patent subsequent to Sep. 21, 2010 has been disclaimed.

[21] Appl. No.: 230,847

[22] Filed: Apr. 21, 1994

Related U.S. Application Data

[63] Continuation-in-part of Ser. No. 124,301, Sep. 20, 1993, abandoned, which is a continuation-in-part of Ser. No. 864,494, Apr. 7, 1992, Pat. No. 5,246,106.

[51] Int. Cl.[6] ..... A47G 19/22

[52] U.S. Cl. ..... 206/217; 206/19; 215/6

[58] Field of Search ..... 222/129, 192; 206/216, 217, 19, 532, 223, 540; 215/6

[56] References Cited

U.S. PATENT DOCUMENTS

| | | | |
|---|---|---|---|
| 2,728,484 | 12/1955 | Farrington | 206/217 X |
| 2,766,796 | 10/1956 | Tupper | 206/217 X |
| 3,083,876 | 4/1963 | Schneider et al. | 222/107 |
| 3,514,029 | 5/1970 | Powell | 206/217 X |
| 3,730,337 | 5/1973 | White | 206/217 X |
| 3,743,520 | 7/1973 | Croner | 222/129 X |
| 3,796,813 | 3/1974 | Kurland | 206/217 |
| 4,033,453 | 7/1977 | Giaimo | 206/217 |
| 4,040,561 | 8/1977 | Philippon | 206/217 X |
| 4,051,977 | 10/1977 | Steinfeld | 206/217 X |
| 4,324,338 | 4/1982 | Beall | 206/217 X |
| 4,387,809 | 6/1983 | Botzler | 222/129 X |
| 4,394,917 | 7/1983 | Looser | 206/217 X |
| 4,609,129 | 9/1986 | Fischer | 222/386 X |
| 4,648,532 | 3/1987 | Green | 222/386 X |
| 4,676,406 | 6/1987 | Frischmann et al. | 222/386 X |
| 4,684,015 | 8/1987 | Vezirian et al. | 206/19 |
| 4,703,849 | 11/1987 | Vezirian et al. | 206/19 X |
| 4,923,702 | 5/1990 | Powell et al. | 206/19 X |
| 5,009,894 | 4/1991 | Hsiao | 206/534 |
| 5,238,140 | 8/1993 | Maze | 206/217 X |
| 5,246,106 | 9/1993 | Johnson | 206/19 X |

FOREIGN PATENT DOCUMENTS

| | | | |
|---|---|---|---|
| 1162107 | 9/1958 | France | 206/217 |

*Primary Examiner*—Kevin P. Shaver
*Attorney, Agent, or Firm*—Dellett and Walters

[57] ABSTRACT

A dispenser comprises a small open-top cup adapted for containing a constituent part of a substance and provided with a substantially flat upper edge or flange. The cup is closed by a two-part lid within which another constituent part of the substance in the form of a wafer is received. The top layer of the lid is first removed to access the wafer and the lower part of the lid is later removed so that the substance within the cup can be accessed. The upper and lower layers of the lid preferably comprise folded-over portions of the same piece of paper-foil or paper-plastic material such that a pull-tab or lift-tab on the upper layer is first grasped to peel back the upper layer and reveal the wafer, after which the top layer is pulled farther upwardly, carrying with it the attached lower layer whereby the substance in the cup can be accessed. The upper and lower layers are heat-sealed to one another and to the edge of the cup in a manner so that they can be conveniently and successively peeled away from the cup.

16 Claims, 4 Drawing Sheets

METHOD AND APPARATUS FOR SUPPLYING TWO-PART SYSTEMS

RELATED CROSS-REFERENCES

This application is a continuation-in-part of U.S. patent application Ser. No. 08/124,301, filed Sep. 20, 1993, now abandoned, which is a continuation-in-part of U.S. patent application Ser. No. 07/864,494, filed Apr. 7, 1992, now U.S. Pat. No. 5,246,106, entitled Compartmented Communion Container.

BACKGROUND OF THE INVENTION

The present invention relates to a two-part dispenser and more particularly to a means and method of delivering a substance with two constituent parts that may be required to be separated until just prior to use.

It is often desirable to provide a substance to be dispensed in two or more constituent parts. Typically, such constituent parts are provided separately and then are combined or consumed together at the particular time of use. Such separation is often necessary in the case of, for example, epoxies wherein the first constituent comprises a hardener that is combined with a second constituent so as to result in a chemical reaction that causes the epoxy to cure. Further, it is often desirable in pharmaceutical uses to have a portion of medicine separated from a second portion so as to preserve the shelf life of the medicine when, for example, the medicine begins to break down once the two constituents are combined or when the combination begins a chemical reaction that results in slow decay of the resulting combined substance.

Other uses may be envisioned where it is desirable to have two constituents separate but delivered together in a convenient package. For example, the ordinance or sacrament of holy communion, which is celebrated on a frequent basis in most Christian churches, involves partaking of the bread followed by the wine or grape juice. These elements often require extensive preparation and special serving plates or containers which are passed to the communicants and then collected. The elements are usually served consecutively inasmuch as they are taken in different parts of the service and it is relatively difficult for the average participant to balance both elements for an extended period of time. Historically, a common cup for the wine was shared by the participants, this being still the practice in many churches.

With small groups or in connection with communion in remote areas, e.g. in the case of battlefield services, the necessary preparations can become difficult and the elements themselves may not be readily available. Therefore, celebration of communion can become infrequent. Even with full facilities, prospective participants may fear contracting communicable diseases especially in areas where sanitation may be a problem.

Moreover, the preparation and serving of the elements sequentially to a large group of people can be quite time-consuming and reduce the time available for other parts of the service. A more efficient plan, so far as the individual is concerned, would be for all communicants to be served and partake of the elements substantially simultaneously.

In pharmaceutical applications, it is desirable to be able to individually administer multi-part medicines to large groups, in a hospital, for example. However, such administration has typically required advance preparation of each of the individual constituents for later delivery to patients. Any unused servings that were already portioned would not be suitable for reuse and would have to be disposed of.

SUMMARY OF THE INVENTION

In accordance with the means and method of the present invention, a dispenser comprises a tapered cup adapted for containing a second constituent and provided with a substantially flat upper edge or radial flange. The cup is closed by a lid removably secured to the cup's upper edge, the lid comprising two centrally separated layers receiving a first constituent in the form of a wafer, for example, therebetween. In use, the top layer is first removed by pulling a lift-tab and the first constituent is either consumed or reserved to be combined with the second constituent. Then, the second or lower layer of the lid is peeled off to provide access to the second constituent within the cup. Again, the second constituent is consumed or otherwise used or receives the first constituent therewithin to produce the combined product.

Preferably the upper and lower layers of the lid comprise folded-over portions of the same piece of paper-foil or paper-plastic material wherein the upper and lower layers of the lid are joined at an edge opposite the pull-tab or lift-tab. Once the first constituent is consumed or accessed and the second constituent portion is to be used, the top layer is pulled farther upwardly, carrying with it the attached lower layer which is thereby removed for providing access to the second constituent therewithin.

The substances within the dispenser can be provided for multiple persons in a substantially simultaneous manner, following earlier placement of the above-described dispensers near the persons. Prepackaging renders the contents completely sanitary and the possibility of spoilage and waste is substantially reduced. Less labor is involved at the time of delivering the substances and immediately therebefore in preparing and serving the constituent elements, and since both elements are supplied simultaneously to the participant, an additional reduction in the time in the delivery is achieved. Convenience in sales and marketing of the substances provided in the dispenser is also achieved.

The dispenser has a low unit cost and allows convenient access to the substances at remote locations and with regard to small groups or individuals, or wherein preparations for use are cumbersome or impossible. While it is envisioned that in particular uses conventional serving trays are generally unnecessary with the present invention, the dispenser in accordance with the present invention can alternatively be substituted for cups currently used in delivering medicine or communion while eliminating the requirement for separately serving the first constituent.

It is accordingly an object of the present invention to provide an improved dispenser means and method.

It is a further object of the present invention to provide an improved means and method for providing substances having two or more constituent parts in a packaged form which is sanitary or stable and which can be utilized in remote areas without extensive preparation.

It is a further object of the present invention to provide an improved dispenser that enables convenient delivery of separated elements for contemporaneous use.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

BRIEF DESCRIPTION OF THE DRAWINGS

FIG. 5 is a perspective view illustrating packaging of dispenser means according to the present invention for shipment to remote areas, points of sale or the like.

DETAILED DESCRIPTION

Figure 1:
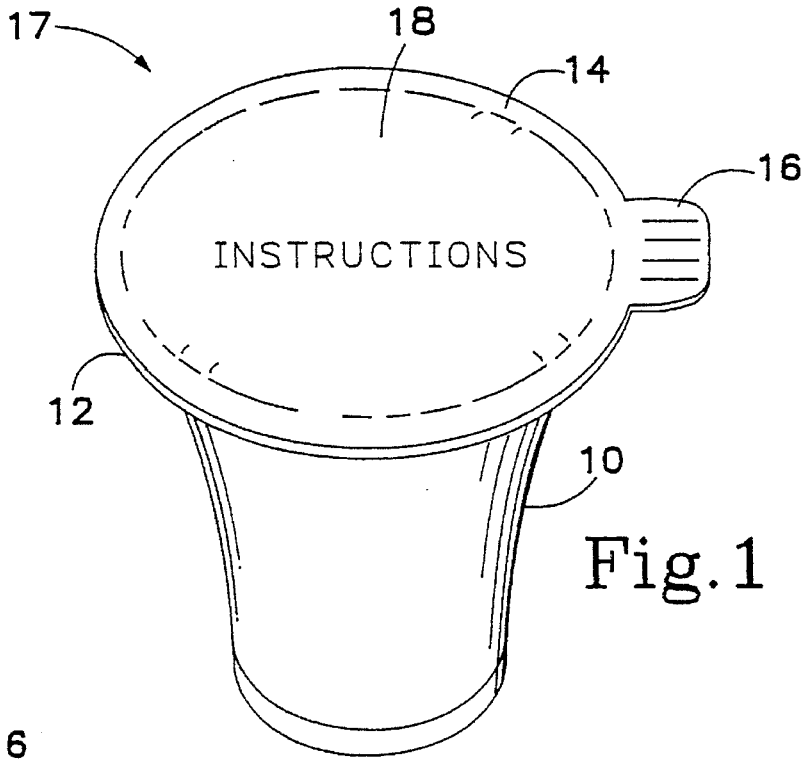
FIG. 1 is a perspective view of a dispenser employed according to the present invention having its imprinted lid sealed in place.

Referring to the drawings and particularly to FIG. 1, a dispenser in accordance with the present invention comprises a small, round, tapered cup 10 adapted for containing a constituent 26 therewithin which may comprise, for example, a liquid. In a particular example, wherein the cup is employed for delivering communion, the constituent 26 may comprise juice or wine. When employing the dispenser for delivery of medication, the cup may contain a liquid portion of medicine or water, for example, or when used in delivery of chemicals, may comprise a substance which needs a catalyst or reactant in order to become active. The top of the cup is formed with a flat upper radial edge or radial flange 12 to which a two-part lid 14 is removably secured. The cup 10 is formed of plastic material (e.g. high-impact polystyrene) and when employed for use in communion, is the approximate size of small communion cups conventionally used in Protestant services. The lid 14 is a paper-foil or paper-plastic material as heretofore used with small cups containing dairy products, salad dressing or the like and is heat-sealed to the radial flange 12 in such manner that it can be peeled off by first grasping pull-tab or lift-tab 16 and pulling upwardly.

Rather than being hand-filled, the cup 10 is preferably filled and sealed with packaging machinery of a known type, e.g. a type 200S system or a Trimline system manufactured by Portion Packaging Inc. of Trevose, Pa., as employed for dairy products and the like. Such a system includes a filler-sealer station with a pump-operated nozzle for filling the cup to the desired extent, and the same head used to fill the cup with the constituent 26 also seals the lid 14 onto the cup rim. The lid is heat-sealed around the top of radial flange 12 but, because of the materials and method of sealing, is readily removed by grasping tab 16 and peeling off the lid in the manner of a dairy product cup. The top of the lid is imprinted with suitable identifying information or instructions for use 17 as shown in FIG. 1.

The lid 14 is comprised of two layers, an upper layer and a lower layer, and the combination is centrally thicker than the usual heat-sealed lid as can be seen in the drawings. The central portion of the lid, at 18, is puckered or distended upwardly, while the lower layer is puckered downwardly to receive a constituent 20 therebetween, which in a particular example is in the form of a wafer about the size of a quarter. The upper layer is distended slightly above the peripheral radial flange 12 of the cup, while the lower layer is distended therebelow. The upper layer **14*a* is peripherally heat-sealed to the lower layer 14*b*, thereby forming a chamber between the layers within which the constituent 20** is initially received.

The lower layer may be depressed as well as heat-sealed onto the cup employing the same filler-sealer head used to supply the constituent 26, or the lids may be initially formed in the distended manner such that the lower layer is concave downwardly while the upper layer is concave upwardly. Alternatively, the distension can simply be provided by the interposition of the constituent 20 on top of lid layer **14*b*** wherein the concavity of the lid layers is imparted when the sealing operation takes place.

The lid 14 may be preassembled from the two layers **14*a* and 14*b* and then applied as a unit to the flange 12 of cup 10, or the layers 14*a* and 14*b* can be individually applied to the cup, for example wherein layer 14*b* is first depressed and heat-sealed to the flange 12, after which layer 14*a* is peripherally heat-sealed on top of layer 14*b*. When the lid is first preassembled and applied as a unit to the cup, the two lid layers desirably comprise parts of the same heat-sealable paper-foil or paper-plastic sheet material, joined at one peripheral edge as indicated at 22 in FIG. 4, and folded over with the constituent 20 therebetween. The heat sealing of layers 14*a* and 14*b*** together before application to the cup can be mechanized employing the aforementioned apparatus to preseal the two layers peripherally, in the same manner the complete lid is then sealed to the cup's edge flange.

Figure 2:
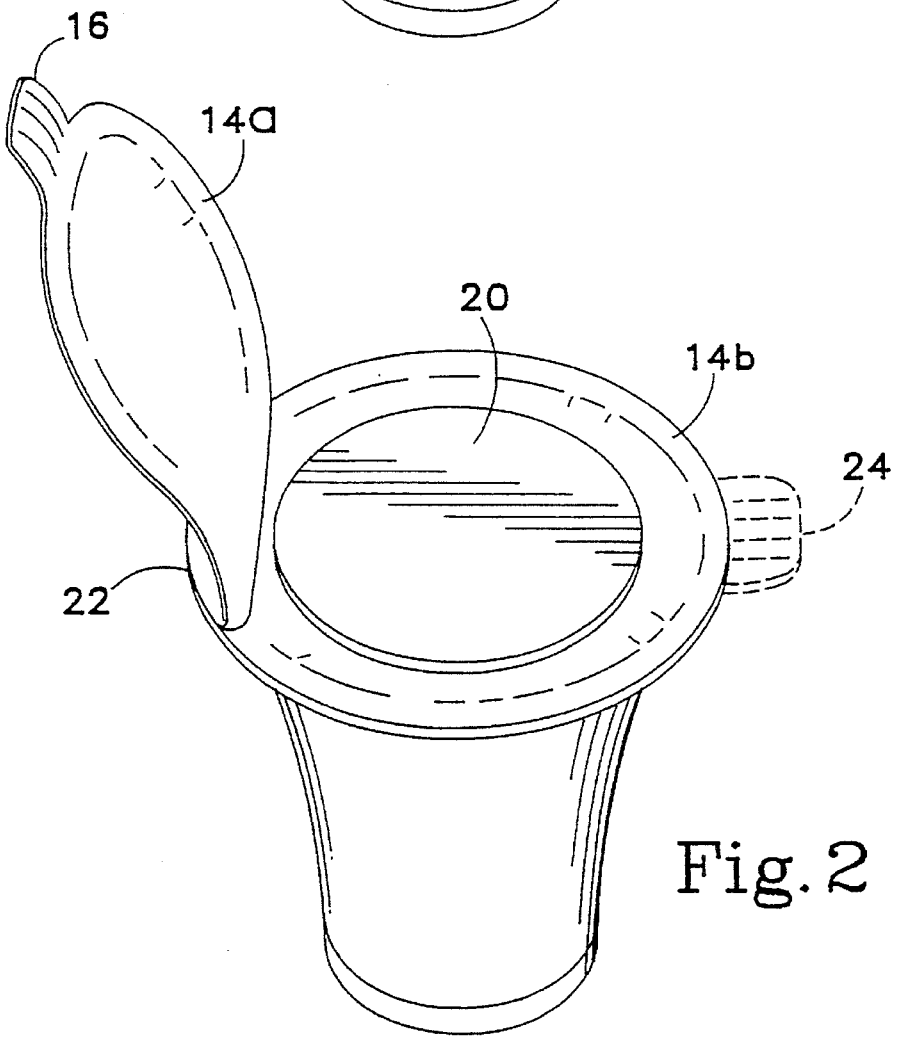
FIG. 2 is a view of the aforementioned dispenser having an upper portion or layer of the lid peeled back to reveal a first constituent supported by an underlayer or portion of the lid.

In the instance of the embodiment wherein the combination of preassembled lid layers has been secured to the cup, access to the constituent 20 is first provided to the user through his separation of the layers as depicted in FIG. 2. The user pulls on pull-tab or lift-tab 16 located diametrically opposite the joinder area 22, lifts upwardly, and peels lid layer **14*a* away from the top of the cup to access the constituent 20**.

Figure 3:
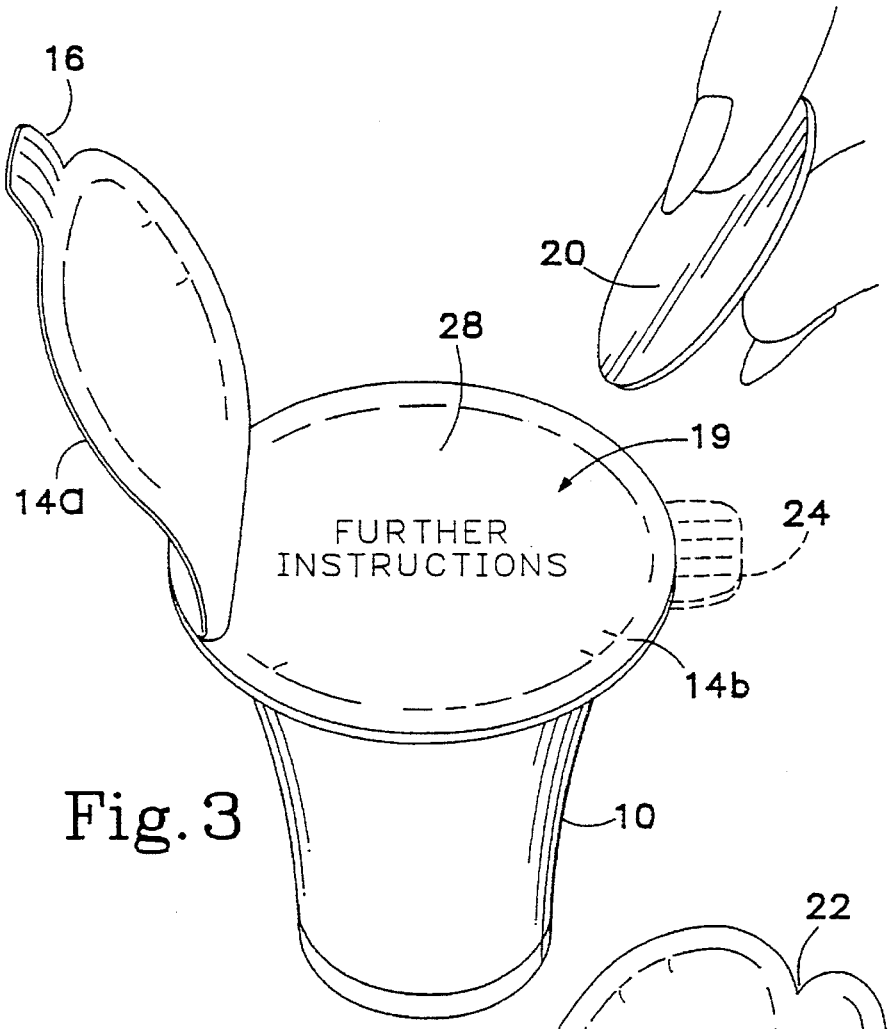
FIG. 3 is a further view of the same dispenser wherein the first constituent has been removed revealing imprinting therebeneath.
Figure 4:
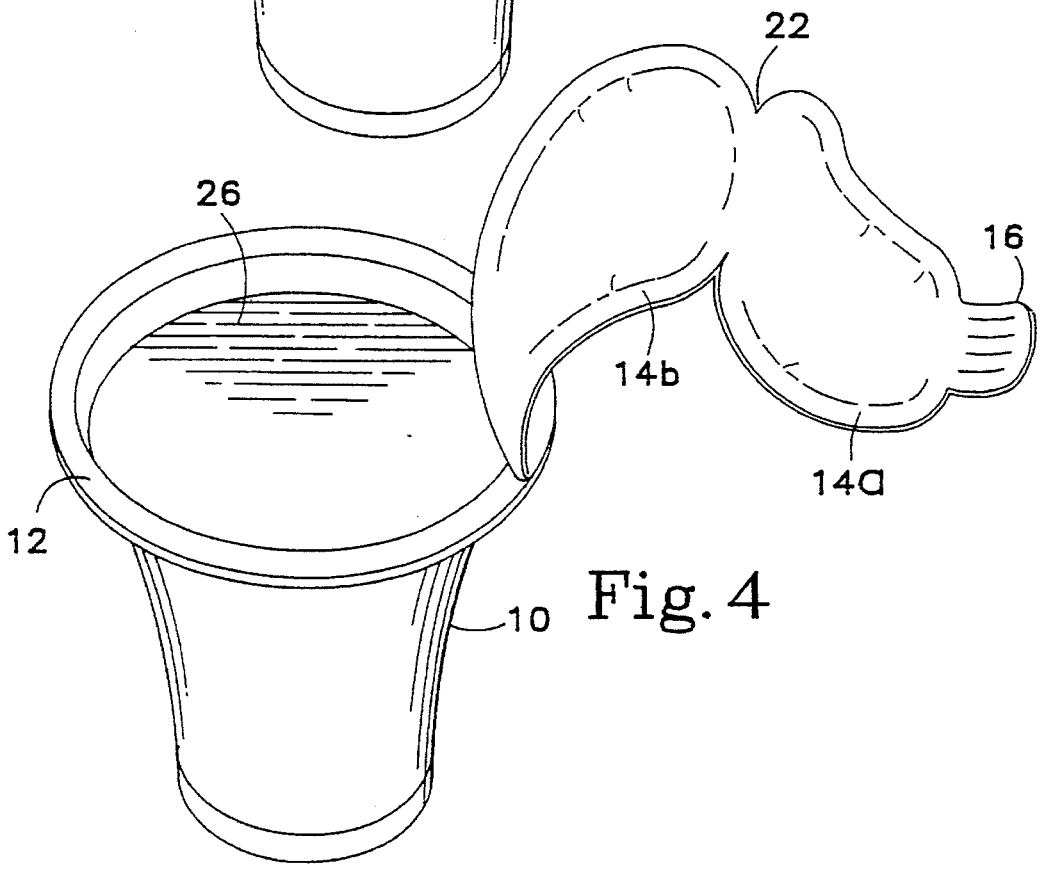
FIG. 4 is a perspective view of the dispenser wherein the two-part lid has been pulled back to provide access to the second constituent contained in the dispenser.

Removal of constituent 20 as indicated in FIG. 3 reveals the upper surface of lid layer **14*b* having further instructions 19 imprinted thereon appropriate for using the second constituent part 26 contained within the dispenser. After the first constituent 20 has been used, and the second constituent is to be taken, the pull-tab or lift-tab 16 is lifted farther upwardly so as to peel back lower layer 14*b* from flange 12 as illustrated in FIG. 4**.

Alternatively, if the lid layers are applied separately to the cup, lower lid layer **14*b* is suitably also provided with a pull-tab or lift-tab indicated in dashed lines at 24 in FIGS. 2 and 3. Tab 24 may be below tab 16 or offset therefrom around the periphery of the cup. After lid layer 14 has been peeled back to provide access to constituent 20 and the same has been taken, pull-tab or lift-tab 24 is employed in the same manner to peel back lower lid layer 14*b* and access the second constituent 26**.

In either the case where the lid layers are first joined together, or where they are applied separately, the lower lid layer **14*b* is more securely adhered to the flange 12 of the cup than the upper layer 14*a* is adhered to lower layer 14*b*, whereby the upper layer always comes off first for access to first constituent 20 instead of the two layers peeling off together. Not only does this accommodate the correct sequence of events when it is desirable to access constituent 20 before accessing constituent 26, but it is also desirable that the stronger sealing be provided between layer 14***b* and the edge flange 12 of the cup to avoid possible spillage of the second constituent. Complete sealing of the constituent 20 between layers 14*a* and 14*b* may not be quite as critical.

Alternatively, when the particular substances are such that constituent 26 is desirably obtained first, lower lid layer 14*b* is more securely adhered to upper layer 14*a* than to flange 12, ensuring that the entire lid is removed from the cup before the two lid layers separate.

When the layers 14*a* and 14*b* are separately and sequentially applied, such application is accomplished with the same type of filler-sealer apparatus as hereinbefore referenced in a multi-step process. The filler-sealer is first employed to mechanically fill the cup with the constituent 26 to the desired level via the machine's filler head, also used to heat-seal lid layer 14*b* to flange 12 so that layer 14*b* is removably adhered to flange 12. At the same time, this head can be employed to depress or render concave the surface of lid layer 14*b* for later reception of constituent 20, i.e., the head can be formed to protrude slightly downwardly for this purpose. The cup, having layer 14*b* adhered thereto, is then conveyed to a second, constituent-dispensing station where constituent 20 is deposited on lid layer 14*b*. Then, the cup is transferred to a third station similar to the first at which lid layer 14*a* is applied atop the combination and heat-sealed around the peripheral interface between the layers so as to be removably adherent to the layer 14*b*.

Figure 6:
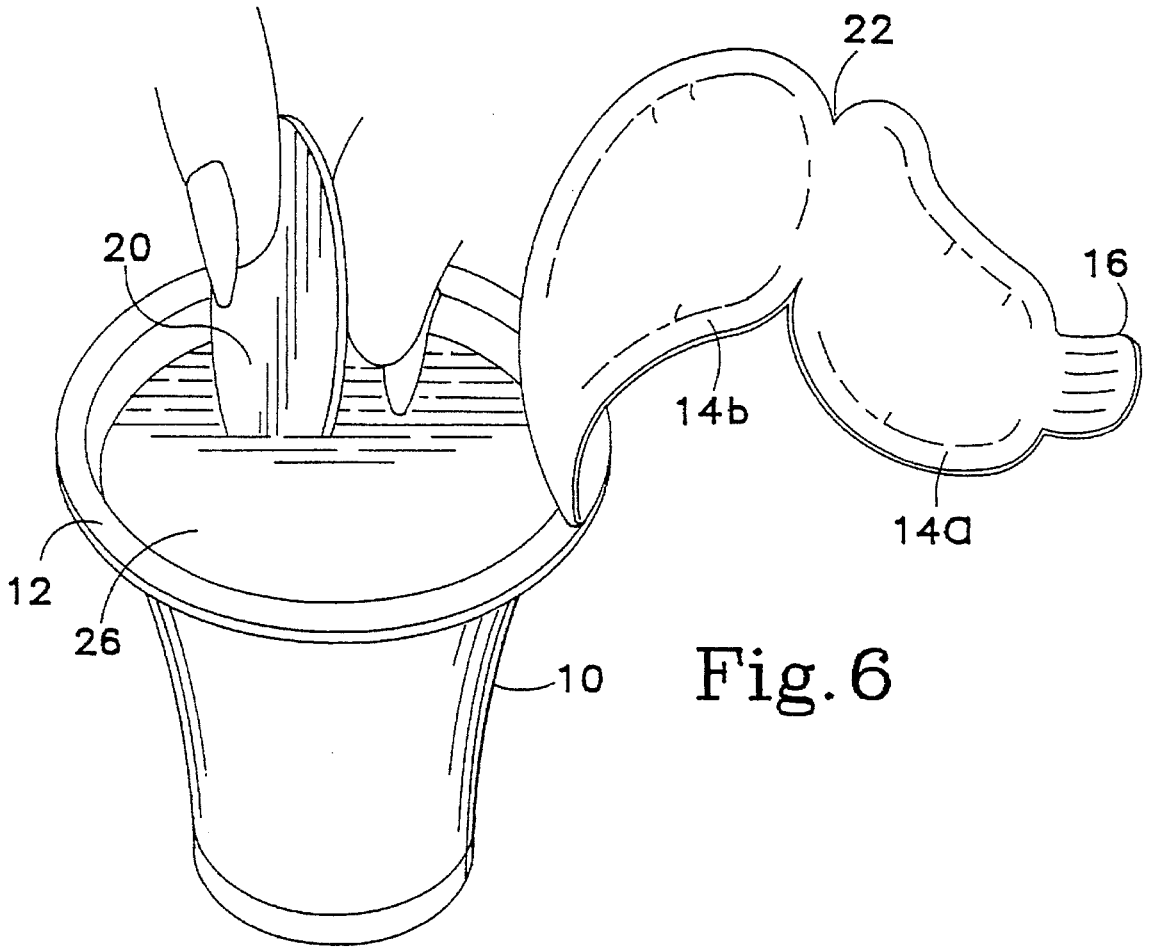
FIG. 6 is a further view of the dispenser wherein the first constituent is inserted into the second constituent by the user.

Referring to FIG. 6, in the case where the constituent 20 is to be inserted within the constituent 26, after removal of both layers 14*a* and 14*b* from the periphery of the dispenser cup, the user may insert the first constituent 20 within the second constituent 26 as illustrated in FIG. 6, wherein in the illustrated embodiment, the second constituent is liquid and the first constituent is a solid. The combined constituents may then be employed for their appropriate use.

Particular examples of the desired uses for the constituents may include, for example, communion wherein the first constituent 20 comprises a communion bread wafer and the second constituent 26 comprises grape juice or wine. The instructions for use may then comprise appropriate scriptures that pertain to the communion service. Another example is where the dispenser is used in pharmaceuticals wherein the first constituent 20 may comprise, for example, a solid medication, while the second constituent may comprise a liquid, i.e. water or a second medicine, which is to be taken in conjunction with the first. The first constituent may then either be consumed by the user followed by the consumption of the second constituent, or the two may be combined so as to react to produce an appropriate substance which is then consumed. Still a further example would employ the dispenser for use with epoxy type adhesives, wherein the first constituent may comprise a catalyst or hardener that is inserted within the second constituent which comprises the adhesive itself. Upon inserting the first constituent within the second constituent as illustrated in FIG. 6, the appropriate reaction then takes place activating the epoxy and causing it to cure. Many other applications may be envisioned wherein the two constituents are maintained separate from one another so as to preserve or lengthen the shelf life of the product. Also, while the dispenser is illustrated as being relatively small, on the order of the size of a cup adapted to be held within the hand of a person, the dispenser could be much larger or smaller depending on the particular application and the constituent substances contained therewithin. Further, illustrated examples show a solid and liquid form for the first and second constituents respectively, but other configurations are also appropriate wherein either of the constituents may be liquid or solid form. Specifically, if the first constituent 20 is in a liquid form, it would be appropriate to first remove the entire lid via peeling of tab 24, thereby revealing the open top of the container to allow access to the second constituent 26. Then, the first and second layers of the lid would be separated by pulling on tabs 16 and 24 in opposite directions so as to allow access to the interior chamber between the two lids and enabling the first constituent to pour out of or be squeezed out of the lid.

Figure 5:
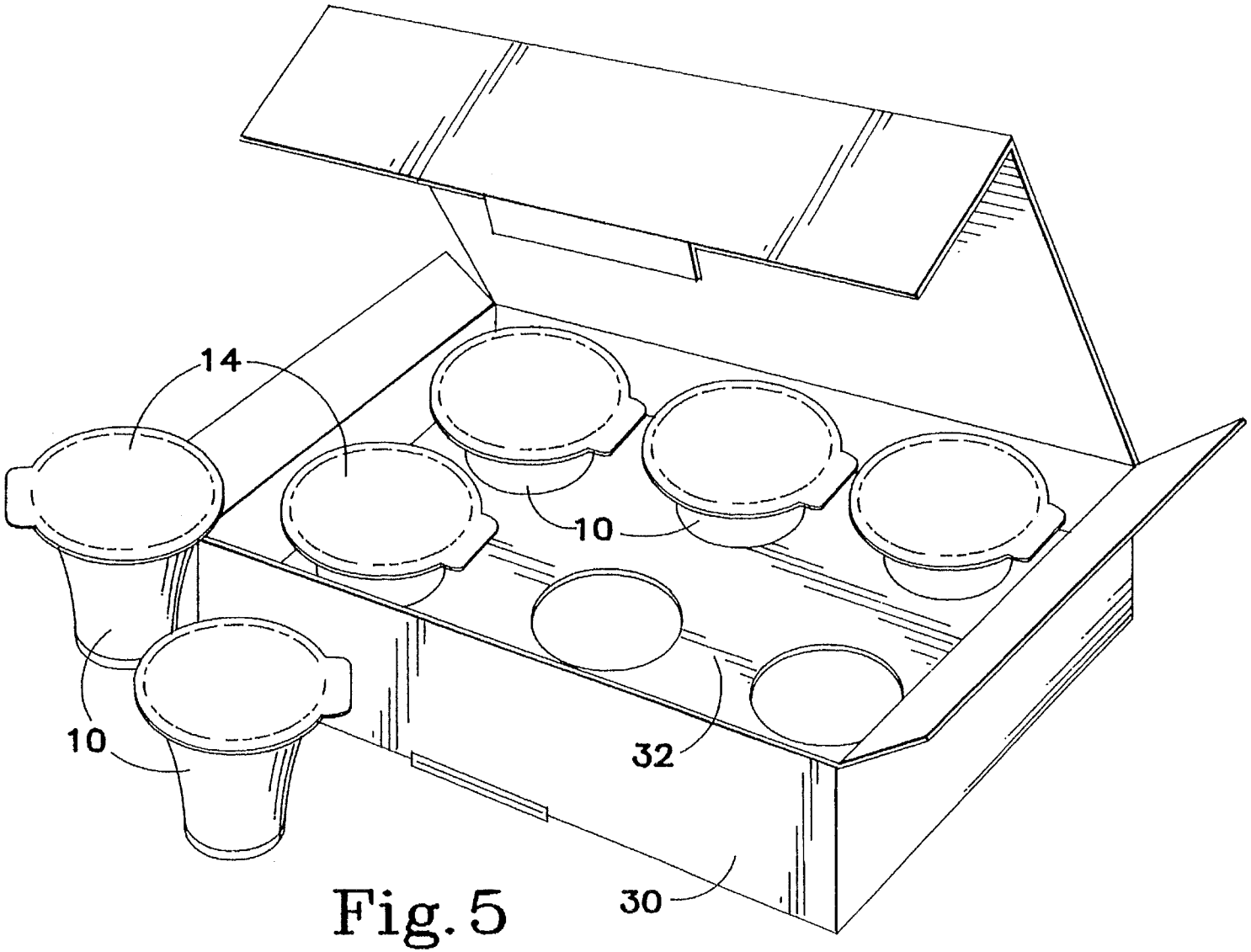

In FIG. 5 a rectangular cardboard container or carton 30 is illustrated which is provided with an apertured horizontal divider 32 for receiving plural dispensers 10 therewithin for shipment or point of sale display. The dispenser according to the present invention is thereby easily transported or carried and can be conveniently used for storage or for serving to small groups at remote locations. The container 30 also provides a degree of sanitation or protection for the exterior of the cups and can be used as a serving/dispensing tray.

The present invention provides a dispenser enabling delivery of substances having two or more constituent part without the requirement of extensive preparation or distribution prior to the time of use. The dispenser cups according to the present invention can be pre-located in racks before use, or can be conveniently passed via the FIG. 5 container or carton as utilized in place of a serving plate or tray. The contents of the cup are maintained in a sanitary condition, lessening the possibility of spoilage and waste, premature reacting or any possible spread of infectious disease. The dispenser according to the present invention has a low unit cost and allows convenient access to the particular substances at remote locations or by small groups or individuals, and where conventional preparations are cumbersome or impossible.

Particular examples of combinations for which the dispenser of the present invention may be suitably employed include sweeteners and creamers, both sugar and artificial sweeteners and dairy and non-dairy creamers. The creamers or sweeteners may be either in liquid, solid or paste forms. Other food products that mix two constituents, either liquid or solid just prior to or during serving may also be employed, e.g. soup base and flavorings. Medications that need to be mixed together, mixed with a liquid or taken with a liquid are also suitable. For example, aspirin and water, Alka-Seltzer™ and water, Antabuse™, contact lens cleaning substances and solutions, denture cleaning substances and solutions. The solutions may suitably comprise water with a solid substance contained in the lid portion of the dispenser, for example, wherein the solid is dissolved in the water (or other suitable liquid) for use. Chemicals and adhesives that are mixed during use or just prior thereto are also well suited for use with the present invention. As noted hereinabove, epoxy and resins are adapted for use with the invention. Other chemicals may be employed, wherein one constituent is liquid and the other is solid or paste. Alternatively, both constituents could be non-liquid and be combined in the cup portion of the dispenser wherein liquid is then added from an outside source if appropriate.

While preferred embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A dispenser for supplying at least two constituent parts comprising:

a two-part lid having an interior chamber containing a first constituent part therewithin wherein said lid comprises a first upper layer and a second lower layer outwardly adjacent one another but centrally spaced apart defining said interior chamber, and an open-top container adapted to receive a second constituent part and said lid, wherein the lower of said two layers is removably adhered to an upper edge of said container and wherein a major portion of a periphery of the upper of said two layers is removably and less securely adhered to a major portion of a periphery of the lower layer so that a user can first separate said upper layer from the lower layer along said major portions for access to said first constituent followed by removal of said lower layer for access to said second constituent and wherein a minor portion of the peripheries of said first and second layers are securely joined to one another along the edge of said container so as not to inhibit upraising of said first layer from said second layer while enabling upraising of said second layer as joined to said first layer by continued upward movement of said first layer substantially after the initial lifting of said first layer, whereby the user can access said first constituent part in said chamber for consumption thereof separately from said second constituent part.

2. A dispenser according to claim 1 wherein said first constituent part comprises a first food product and wherein said second constituent part comprises a second food product.

3. A dispenser according to claim 1 wherein said first constituent part comprises a sweetener and said second constituent part comprises dairy or non-dairy creamer.

4. A dispenser according to claim 1 wherein one of said constituents comprises Antabuse or a preparation of disulfiram.

5. A dispenser according to claim 1 wherein one of said constituents comprises an analgesic.

6. A dispenser according to claim 1 wherein said first and second constituents together comprise a denture cleaning preparation.

7. A dispenser according to claim 1 wherein said first and second constituents together comprise a lens cleaning preparation.

8. A dispenser according to claim 1 wherein said lid comprises heat-sealable material.

9. The dispenser according to claim 1 wherein said open-top container is formed of plastic.

10. A method of providing a dispenser for at least two constituent parts comprising:

at least partially filling a container having a peripheral top with a first constituent, removably adhering a first lower lid layer to the peripheral top of said container in a manner for substantially sealing said first constituent within said container but whereby said first lid layer can be peeled away from the top of said container for providing access to said first constituent, positioning a second constituent on top of said first lid layer, and removably adhering a second upper lid layer peripherally to the first lid layer where the first lid layer adjoins the top of said cup to provide a chamber for receiving said second constituent whereby said second lid layer can be peeled away for access to said second constituent, wherein when the lower of said two layers is removably adhered to the peripheral top of said container, a major portion of a periphery of the upper of said two layers is removably and less securely adhered to a major portion of a periphery of the lower layer so that a user can first separate said upper layer from the lower layer along said major portions for access to said first constituent followed by removal of said lower layer for access to said second constituent and wherein a minor portion of the peripheries of said first and second layers are securely joined to one another along the edge of said container so as not to inhibit upraising of said upper layer from said lower layer while enabling upraising of said lower layer as joined to said upper layer by continued upward movement of said upper layer substantially after the initial lifting of said upper layer.

11. A dispenser for supplying a medication having at least a first part and a second part comprising:

a lid having an interior chamber adapted to contain the first part of the medication therewithin, wherein said lid comprises a first upper layer and a second lower layer defining said interior chamber, and an open-top container adapted to receive the second part of the medication, wherein the lower of said two layers is removably adhered to an upper edge of said container and wherein a major portion of a periphery of the upper of said two layers is removably and less securely adhered to a major portion of a periphery of the lower layer so that a user can first separate said upper layer from the lower layer along said major portions for access to said first constituent followed by removal of said lower layer for access to said second constituent and wherein a minor portion of the peripheries of said first and second layers are securely joined to one another along the edge of said container so as not to inhibit upraising of said first layer from said second layer while enabling upraising of said second layer as joined to said first layer by continued upward movement of said first layer substantially after the initial lifting of said first layer, whereby the user can access said first part of the medication in said chamber for consumption thereof separately from said second part of the medication.

12. A dispenser according to claim 11 wherein said lid comprises heat-sealable material.

13. The dispenser according to claim 11 wherein said open-top container is formed of plastic.

14. A dispenser for supplying an adhesive having at least a first part and a second part comprising:

a lid having an interior chamber adapted to contain the first part of the adhesive therewithin, wherein said lid comprises a first upper layer and a second lower layer defining said interior chamber, and an open-top container adapted to receive the second part of the adhesive, wherein the lower of said two layers is removably adhered to an upper edge of said container and wherein a major portion of a periphery of the upper of said two layers is removably and less securely adhered to a major portion of a periphery of the lower layer so that a user can first separate said upper layer from the lower layer along said major portions for access to said first part of the adhesive followed by removal of said lower layer for access to said second part of the adhesive and wherein a minor portion of the peripheries of said first and second layers are securely joined to one another along the edge of said container so as not to inhibit upraising of said first layer from said second layer while enabling upraising of said second layer as joined to said first layer by continued upward movement of said first layer substantially after the initial lifting of said first layer, whereby the user can access said first part of the adhesive in said chamber for combining with said second part of the adhesive immediately prior to use of the adhesive, thereby activating curing of the adhesive.

15. A method of taking medicine supplied in a dispenser carrying at least two constituent parts, comprising the steps of:

accessing a first constituent part from said dispenser and consuming said first constituent part; and accessing a second constituent part from said dispenser and consuming said second constituent part, wherein said first constituent part is provided in a lid having an interior chamber and said second constituent part is provided in an open-top container for which said lid provides covering and wherein said lid comprises a first upper layer and a second lower layer defining said interior chamber, and wherein the lower of said two layers is removably adhered to an upper edge of said container and wherein a major portion of a periphery of the upper of said two layers is removably and less securely adhered to a major portion of a periphery of the lower layer so that a user can first separate said upper layer from the lower layer along said major portions for access to said first constituent part followed by removal of said lower layer for access to said second constituent part and wherein a minor portion of the peripheries of said first and second layers are securely joined to one another along the edge of said container so as not to inhibit upraising of said first layer from said second layer while enabling upraising of said second layer as joined to said first layer by continued upward movement of said first layer substantially after the initial lifting of said first layer.

16. The method according to claim 15 wherein said first constituent part comprises a medication and said second constituent part comprises a liquid to assist in consumption of the medication.

* * * * *